United States Patent [19]

Smith

[11] Patent Number: 4,850,809

[45] Date of Patent: Jul. 25, 1989

[54] AIR OPERATED LOW PRESSURE SPRAYING SYSTEM

[76] Inventor: William C. Smith, 7701 Whiterim Ter., Potomac, Md. 20854

[21] Appl. No.: 181,521

[22] Filed: Apr. 14, 1988

[51] Int. Cl.[4] ..... F04B 23/00

[52] U.S. Cl. ..... 417/76; 417/183; 417/190; 239/354; 137/893

[58] Field of Search ..... 417/183, 184, 182, 151, 417/190, 191, 76, 158, 181, 178; 239/311, 318, 341, 354; 137/891, 892, 893

[56] References Cited

U.S. PATENT DOCUMENTS

| | | | |
|---|---|---|---|
| 1,922,920 | 8/1933 | Aherne | 417/183 |
| 2,767,727 | 10/1956 | Acomb | 417/184 |
| 2,931,580 | 4/1960 | Johnson | 239/311 |
| 3,282,227 | 11/1966 | Nielsen | 417/183 |
| 3,633,828 | 1/1972 | Larson | 239/412 |
| 3,906,996 | 9/1975 | DePass et al. | 137/893 |
| 4,462,429 | 7/1984 | Coursen | 137/891 |
| 4,681,372 | 7/1987 | McClure | 417/183 |

*Primary Examiner*—Leonard E. Smith
*Assistant Examiner*—Robert N. Blackman
*Attorney, Agent, or Firm*—Birch, Stewart, Kolasch & Birch

[57] ABSTRACT

Apparatus for converting high pressure, low volume air to low pressure, high volume filtered air in order to successfully atomize fluids, such as paint, of various viscosities. The invention makes it possible to utilize safe, economical compressor air to atomize fluids by a portable enclosure including a variable jet venturi induction pump which separates the pump from the area of application and other potentially contaminating elements. Ambient air is introduced into the portable enclosure after regulation and filtration. A low pressure field is established in the induction pump by increasing the velocity of the compressor air in a venturi section of the pump but is free of contaminates generated, for example, by overspray in the vicinity of the area of application.

17 Claims, 4 Drawing Sheets

AIR OPERATED LOW PRESSURE SPRAYING SYSTEM

BACKGROUND OF THE INVENTION

This invention relates generally to the atomization of fluids and more particularly to the atomization and entrainment of fluids, such as paint, for application to a surface.

Two types of apparatus for the atomization and particulation of fluids are currently in use, namely pneumatic and airless. As they refer to application of coatings both types comprise high pressure apparatus.

Airless equipment operate under ultra high pressures of 1800 to 2500 psig. Through the use of hydraulic pressure, the fluid is conveyed to a spraying apparatus where it is forced through a small orifice. The high pressure by which it is propelled causes it to pebble the surface finish. This high pressure is also responsible for a condition known as "bounceback" whereby the fluid literally bounces back into the atmosphere of the work place. It contaminates the environment, the worker and the equipment. It also wastes materials and requires considerable clean up time. Ultra high pressures make finish control impractical and can be dangerous to the user.

Conventional pneumatic apparatus utilize high pressure, low volume compressor or "shop air" in concert with an air regulator to atomize fluids. One of its chief features is it is inexpensive to operate and maintain, and is controllable. While the results are a fine finish, it has the disadvantage of producing a wasteful cloud of fluid and air commonly referred to as "overspray". The solvent vapors become part of the atmosphere and present a hazard not only to the environment but also to the atomizing equipment. The visible components of overspray are the solids which result in the degrading of the quality of the work surface and contamination of the work area. "Bounceback" of high pressure, airless systems also generate a type of overspray. This condition is created by the high velocity by which the fluid is propelled to the surface. The rebounding particles, solids and vapors, form an overspray cloud similar to that generated by pneumatic apparatus.

Overspray and its reduction has become a subject of major concern to any industry involved in the atomization of fluids. An amendment to the "Clear Air Act" of February, 1987 as it relates to hydrocarbon emission controls, established limitations and standards of performance for fluid transfer. Those industries affected are manufacturers and end users of commercial and consumer solvents, architectural coatings, pesticides, and all apparatus and methods involved in their application. Particular emphasis is being placed on government and military applicators. Additionally, individual states are implementing this act with their own pollution control bills. In some cases, such as California, high pressure paint systems and adaptations that rely on high pressure, low volume application of atomization are being studied for restricted use. This could have a disasterous effect on thousands of small businesses. Manufacturers of fluids, in order to reduce the percentage of carrier solvents, are now required to increase their solids content. This places a new burden on the atomizing system to atomize these high solids.

High solid materials are substantially more expensive and places new emphasis on transfer efficiency. An adaptation of the conventional method of spraying used where there has been a requirement for fine finishing and reduced overspray relies on the use of a high speed, electrically driven turbine. It delivers low pressure, high volume atomizing air and very successfully atomizes fluid viscosities of low to middle ranges. The apparatus has a transfer efficiency of approximately 70%. Transfer efficiency is expressed in percentages. For example, if a device or method is 70% efficient, it moves 70% of the solids of a container to the work surface. Conventional pneumatic systems have a common transfer efficiency of 35%. Airless systems are generally accepted to be 45% efficient.

Disadvantages of the turbine type equipment include its inability to transport low pressure air long distances. It does not have the power to successfully atomize high solid fluids, nor does it have the ability to adjust to varying viscosities. Because it is electric, it should not be used in explosive atmospheres such as aircraft hangers, ship interiors or inside paint booths.

All spraying systems require an apparatus to atomize the fluid and deliver it to the work surface. This apparatus is commonly called a spray gun. Guns vary in their configuration, size, weight and internal composition. Most attempts at improved fluid atomization for the purposes of spray painting have been directed to the gun. One such application centered on the location of a jet venturi induction pump located in the handle of the gun. Its failure to achieve commercial acceptability was due to the location to the jet venturi induction pump. Its function was to convert high pressure, low volume shop air to low pressure, high volume air. However, because of its close proximity to the work area, the ambient air drawn into the device was contaminated. Therefore the jet venturi induction pump was continuously introducing contaminated air into its internals. As a result, this contaminated air left deposits on the internal passages and orifices of the apparatus causing it to malfunction. Additionally, the user's hand could easily block the induction ports preventing a continuous inflow of ambient air. The entire system, as a result, was dominated by shop air. Lastly, the type of apparatus cannot be adjusted to meet varying fluid viscosities. All these adverse conditions negated the role of the devices as an improved method. To successfully atomize conventionally, pressures of 50 to 60 psig and 4 or 5 cfm. are required. The gun is designed to atomize fluids by the violent forward motion of the air as it exits the nozzle. Because the air nozzle is considerably larger than the fluid nozzle, it delivers more air than is necessary. The explosion into the atmosphere results in "overspray". There is a direct relationship between overspray and high pressure.

Therefore, there is an urgent need, according to standards now being introduced and currently in practice, for equipment that can meet these requirements. There is a need for apparatus that is capable of delivering low pressure, high volume air at acceptable transfer efficiency percentages, production rate standards and finish quality. Pressure control to atomize the new high solid fluids is also vital to its use. It must reduce volatile organic compounds to a level above new federal and state laws. The objectives of this improvement should be to reduce cleaning and maintenance problems. It should be portable and inexpensive to own. Furthermore, such apparatus should allow freedom of movement, ease of application and usable where paint booths are impractical or where atmospheres are explosive.

The wide use of paint spraying booths has focused attention to such cost factors as filter maintenance and airflow rates. Additionally, there is a need for apparatus that can be used inside the usually explosive environment present in spraying booths. Ideally, this apparatus should be capable of using existing spraying devices such as pressure regulators, filters, air dryers, fluid mixing equipment, pressure vessels, and fluid lines. The savings, represented by such an improvement, would be incalculable to the fabricator and refurbisher in both the public and private sector.

SUMMARY

Accordingly, the present invention is directed to a method and apparatus by which contaminated, high pressure, low volume compressor air is inexpensively and successfully converted to a mechanically controllable, low pressure, high volume filtered air for the purpose of improving atomization of fluids, and as applied to spray painting, it comprises a method and apparatus which makes this conversion possible. In contrast to prior air driven systems, the present invention greatly reduces the wasteful and polluting cloud of unused atomizing fluid known as "overspray" or "bounceback" and is achieved through a specific arrangement of a jet venturi induction pump within an enclosure remote from the atomizer and out of range of overspray produced thereby. It is the physical location of the apparatus that is removed from the area of application that is unique and critical to its superior function.

The subject invention is used in concert with conventional spray system components: an air compressor, air filter, air regulator, hoses and an applicator and is situated between the compressor, the energy source, and the area of use, i.e. the atomizer. It is an object of this invention to prevent the re-introduction of overspray into the applicator and thus back into the system as is common with known prior art spraying equipment. Since the quality and control of atomizing air is critical to fine finishing, low atomizing pressure is essential. This invention provides that the previously filtered and regulated but still high pressure air flowing into a housing device by way of a piping arrangement enters the jet venturi which is specifically situated so as to increase the velocity of the partially deregulated and filtered air. The relationships of the interior devices have the capacity to increase or decrease the quality of the low pressure field that is created in these devices.

Accordingly, the induction pump permitting the induction of ambient air can be adjusted if required for the atomization of various fluid viscosities. The distance between the regulator filter and the jet venturi induction pump is calculated to prevent the recondensation of water in the regulated and filtered air. The induction area serves the broadest number of functions in the assembly. It receives the air whose elevated velocity creates the low pressure field. The residual compressor air and filtered ambient air mix in this area. The interior configuration of the pump's passageways are designed to increase the mixed air's velocity and further reduce the pressure of the atomizing air. The result is clean, low pressure, high volume air ready to be used for atomization.

As it relates to the field of spray painting, it is an object of the invention to provide improved apparatus for the atomization of fluids in union with existing devices and components. The result is an assembly capable of using compressor air of commonly used pressures and acceptable degrees of contamination to energize the apparatus and also permit its use in potentially explosive atmospheres. A further object of the invention is to provide an assembly for advanced and improved control of the filtered regulated air which is the final stage in conventional pneumatic systems but an intermediate stage in this invention. The subject invention provides soft spray patterns with minimum overspray. Also the finish quality is significantly improved. Further, it reduces fluid use and environmental emissions or volatile organic compounds. The restriction of pollutants, solids and solvents, emitted into the atmosphere also prevents hazards to the user. Reduced preparation and clean up time are added benefits. Advantages in reduced parts inventories and low maintenance costs become evident because the apparatus of the invention has no operating parts. By this is meant the viscosity adjustment, a moving part, within the components is a metering not an operating part. These and other objects of the present invention will become readily apparent from the following specification, when read in conjunction with the accompanying drawings illustrating the invention.

DESCRIPTION OF THE PREFERRED EMBODIMENT

Figure 1:
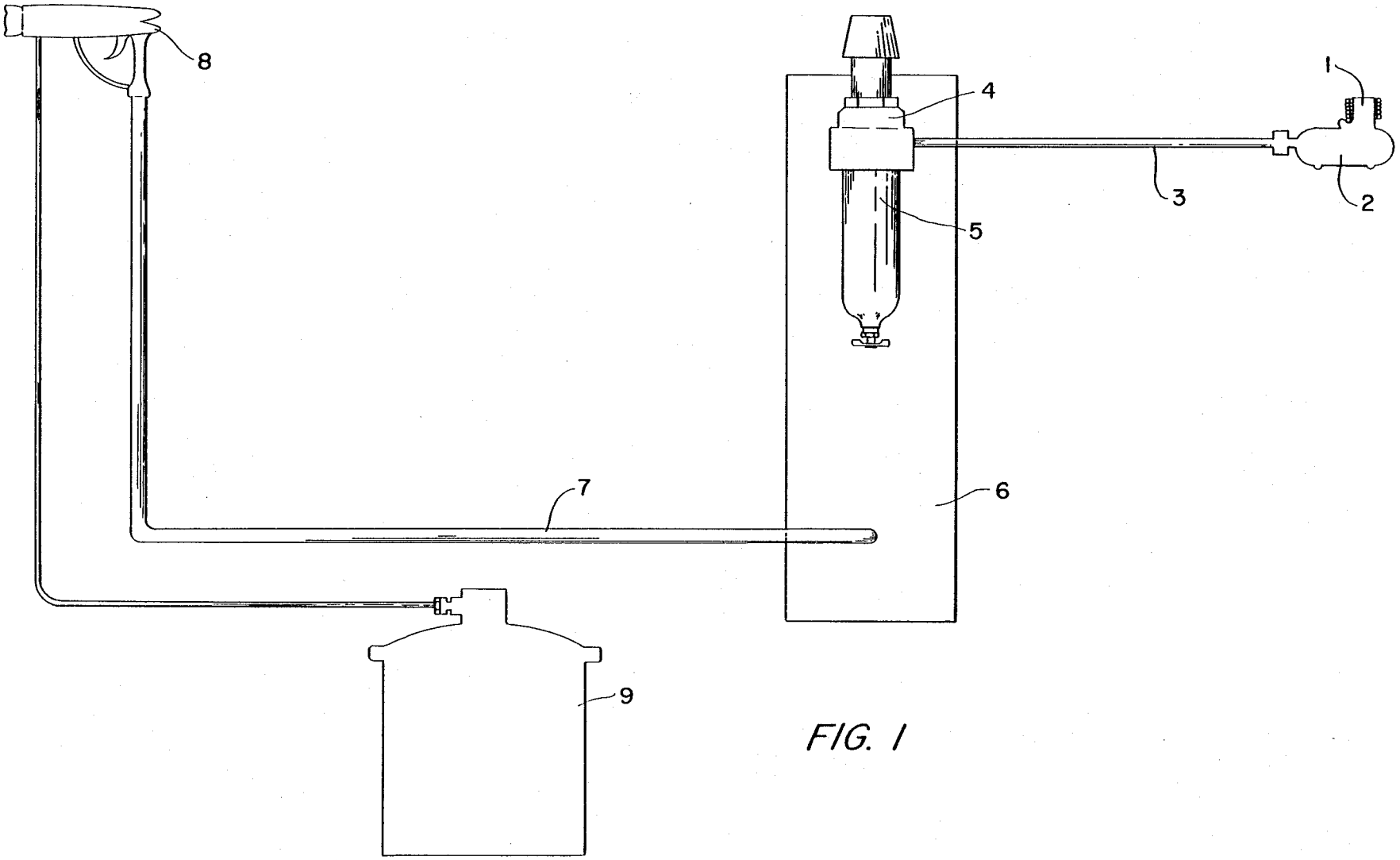
FIG. 1 is a mechanical schematic diagram illustrative of the preferred embodiment of the invention.

FIG. 1 is a schematic overview of the subject invention as integrated into a system for atomizing fluids. As shown, an air compressor 1 comprises the source of energy. Compressed air is stored in the compressor's tank 2 and conveyed as required by an air hose 3 to a pressure regulator 4 whose function is to provide the exact air pressure required for atomization. An air filter 5 is affixed to the regulator 4 and is employed to decontaminate the compressed air from moisture, oil, rust and dirt. When desirable, the filter 5 can be separate from the regulator 4. Reference numeral 6 denotes apparatus according to the present invention for reducing the regulated, filtered air to a final stage low pressure, atomizing air. This low pressure air, the atomizing air, is next transported by a hose 7 to the atomizer 8 which is located away from the apparatus while receiving the atomizing air and the fluid to be atomized from a cannister 9.

Figure 2:
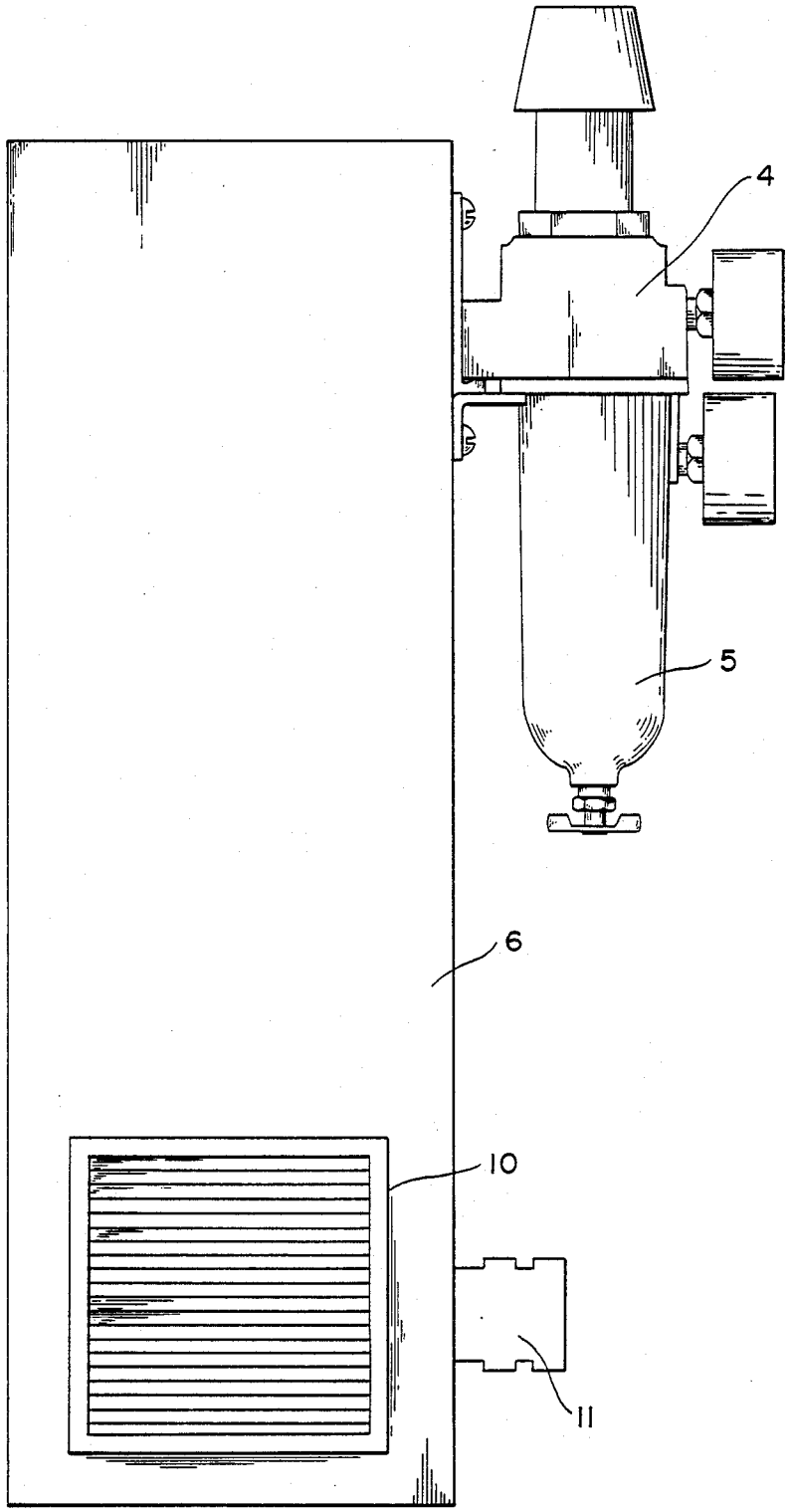
FIG. 2 is a side elevational view of the enclosure shown in FIG. 1 and being further illustrative of the ambient air filter and atomizing air outlet therein.
Figure 4:
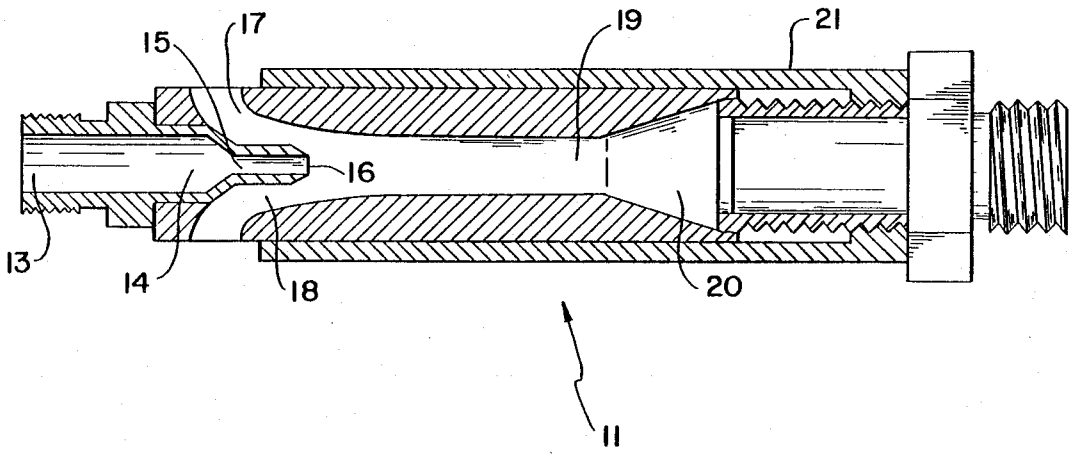
FIG. 4 is a central longitudinal cross sectional view of the jet venturi induction pump shown in FIG. 3.

Referring now to FIG. 2 which discloses a side view of the enclosure 6, an ambient air filter 10 is shown at the lower section of this enclosure adjacent a jet venturi induction pump 11, the details of which are shown in FIG. 4. The function of the filter 10 is to filter the ambient air entering the pump 11 of moisture and other contaminants that may be present in the immediate vicinity.

Figure 3:
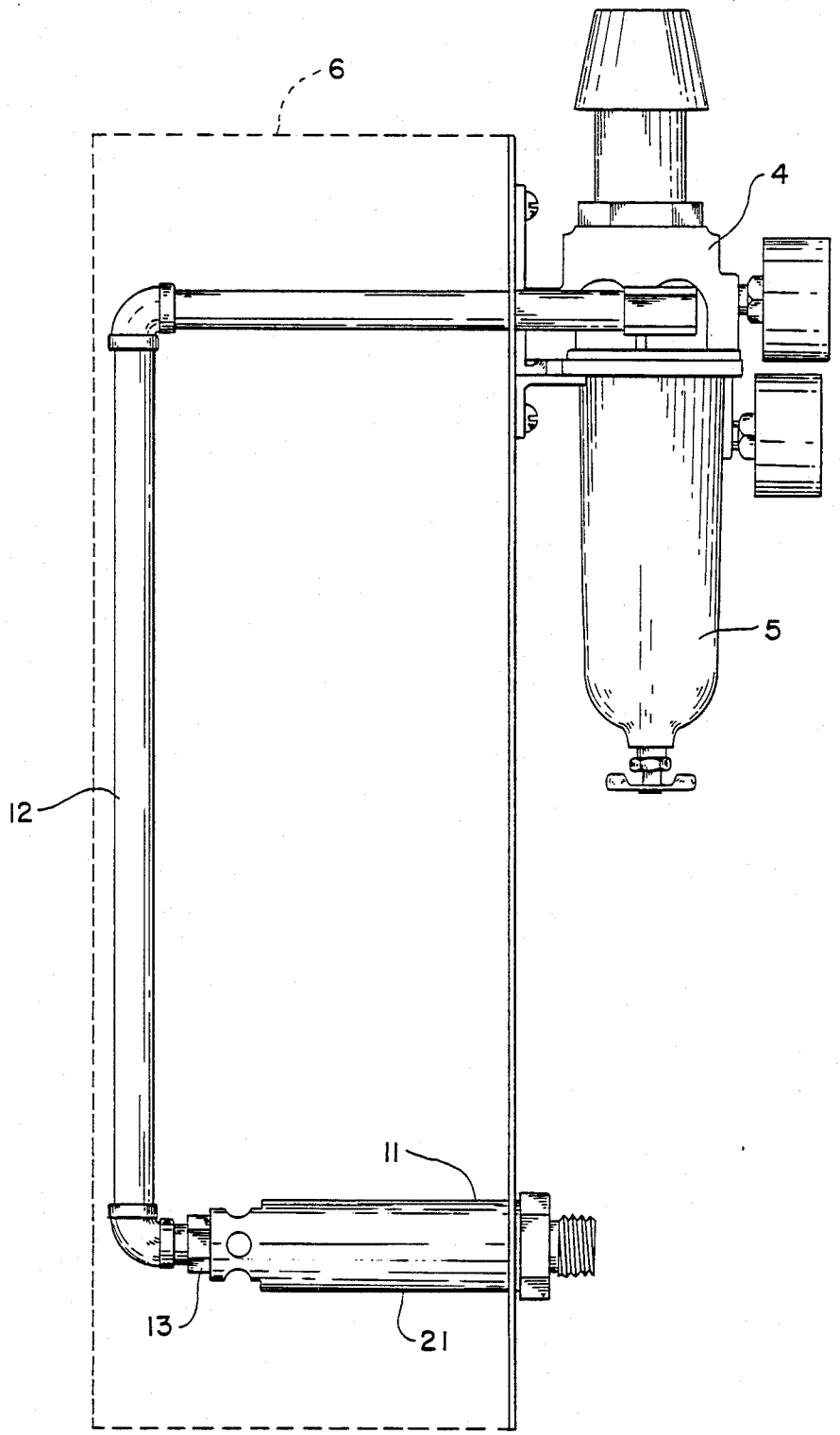
FIG. 3 is a side elevational view illustrative of the position of the jet venturi induction pump located within the enclosure shown in FIG. 2.

FIG. 3 is a sideview illustrating the pump 11 according to the present invention detailing its position in the enclosure 6 relative to the ambient air filter 10. As shown in FIG. 2, the internal piping 12 directs the regulated and filtered intermediate pressurized compressor air from the elements 4 and 5 to the jet venturi nozzle entrance area 13.

FIG. 4 is an enlarged central longitudinal cross sectional view of the jet venturi pump 11 implementing the invention's air pressure conversion process. At region 14 the compressor air from line 12 converges at the throat of the venturi nozzle 15, wherein the compressor air velocity is maximized. The high velocity causes below ambient pressure air to exit at 16 and which is called the free jet area. The region 16 may also be described as a low pressure field. At this point, external ambient air received, for example, through the filter 10 at one atmosphere pressure flows to the low pressure field region 16 through the induction duct ports 17. The ambient air mixes with the low pressure compressor air in the upstream section of the venturi at 18 and flows toward the area 19 called the pressure recovery section where finalizing of the atomizing air occurs at the divergent section of the venturi 20.

To increase the pressure of the atomizing air at 20, a sleeve 21 is threaded to the exterior body of the jet venturi induction pump. The function of the sleeve 21 is to close or open the induction duct ports 17 controlling the inflow of the ambient air to the region 18, increasing or decreasing its volume and pressure by rotation of the sleeve causing it to move longitudinally by the action of the threads on the pump body.

Accordingly, high viscosity fluids requiring higher pressure to atomize can be easily accommodated as needed. Since the jet venturi induction pump 11 is separated from and located remotely from the atomizer 8 (FIG. 1), the problem of reintroduction of overspray into induction dust ports 17 is obviated.

I claim:

1. Apparatus for atomizing a fluid delivered thereto from a source and powered by compressed air from a compressor, comprising:

an atomizer including means for being coupled to said source; and a jet venturi induction pump coupled between said compressor and said atomizer, said induction pump being located in an enclosure apart from and at a predetermined distance away from said atomizer so that overspray produced thereby is prevented from being fed into said pump along with compressed air from said compressor, and said induction pump further including a venturi section and at least one induction port for the delivery of ambient air to said venturi section and additionally including filter means located adjacent said induction port for filtering the ambient air prior to reaching said induction port.

2. The apparatus as defined by claim 1 wherein said filter means is secured to the portable enclosure adjacent said induction pump.

3. The apparatus as defined by claim 1 wherein said enclosure comprises a portable enclosure.

4. A method for atomizing a fluid delivered from a source, comprising the steps of:

coupling an atomizer to said source and powering said atomizer by compressed air;

coupling a jet venturi induction pump, including a venturi section and at least one induction port mounted in an enclosure, between said compressor and said atomizer and locating said enclosure apart from and at a predetermined distance away from said atomizer thereby preventing overspray produced by the atomizer from being fed into said pump along with compressed air from said compressor; and filtering and feeding ambient air to said at least one induction port.

5. The method of claim 4 wherein said source comprises a paint source.

6. The method as defined by claim 4 wherein said enclosure comprises a portable enclosure.

7. The method as defined by claim 4 and additionally including the step of regulating the compressed air powering said atomizer from said compressor.

8. The method as defined by claim 6 and additionally including the step of filtering the compressed air powering said atomizer.

9. Apparatus for atomizing a fluid delivered thereto from a source and powered by compressed air from a compressor, comprising:

an atomizer including means for being coupled to said source;

a jet venturi induction pump coupled between said compressor and said atomizer, said induction pump being located in an enclosure apart from and at a predetermined distance away from said atomizer so that overspray produced thereby is prevented from being fed into said pump along with compressed air from said compressor, said induction pump further including a venturi section and at least one induction port for the delivery of ambient air to said venturi section and additionally including filter means located adjacent said induction port for filtering the ambient air prior to reaching said induction port; and a pressure regulator coupled between the compressor and the induction pump.

10. The apparatus as defined by claim 9 wherein said enclosure comprises a portable enclosure.

11. The apparatus as defined by claim 9 wherein said regulator is mounted on said portable enclosure.

12. The apparatus as defined by claim 9 and additionally including air filter means coupled between the compressor and the induction pump.

13. The apparatus as defined by claim 12 wherein said air filter means is integral with said pressure regulator and mounted in said portable enclosure.

14. Apparatus for atomizing a fluid delivered thereto from a source and powered by compressed air from a compressor, comprising:

an atomizer including means for being coupled to said source;

a jet venturi induction pump coupled between said compressor and said atomizer, said induction pump being located in an enclosure apart from and at a predetermined distance away from said atomizer so that overspray produced thereby is prevented from being fed into said pump along with compressed air from said compressor, wherein said induction pump includes a venturi section and induction port means for delivering ambient air to said venturi section, and further including means for varying said induction port means to vary the volume and pressure of the ambient air delivered to said venturi section for atomizing fluids of varying viscosity.

15. The apparatus as defined by claim 14 wherein said enclosure comprises a portable enclosure.

16. The apparatus as defined by claim 14 wherein means for varying said induction port means comprises an axially movable sleeve mounted on the outside of said induction pump for varying the amount of ambient air permitted into said venturi section.

17. The apparatus as defined by claim 14 wherein said induction pump includes a generally circular cylindrical body portion and wherein said sleeve comprises an elongated sleeve threadably attached to said body portion and being rotatable to provide longitudinal movement axially along said body portion.

* * * * *